United States Patent [19]

Cardone et al.

[11] 4,250,478

[45] Feb. 10, 1981

[54] MANUALLY CONTROLLED MAGNETIC LIFTING DEVICE

[75] Inventors: Michele Cardone; Angelo Grandini; Bruno Zaramella, all of Milan, Italy

[73] Assignee: Tecnomagnetica di Cardone, Grandini, Zaramella & C. S. a.s., Milan, Italy

[21] Appl. No.: 89,251

[22] Filed: Oct. 29, 1979

[30] Foreign Application Priority Data

Nov. 17, 1978 [IT] Italy ..... 23323/78[U]

[51] Int. Cl.[3] ..... H01F 7/20

[52] U.S. Cl. ..... 335/288; 335/295

[58] Field of Search ..... 335/285, 288, 289, 291, 335/295

[56] References Cited

U.S. PATENT DOCUMENTS

| | | | |
|---|---|---|---|
| 2,471,067 | 5/1949 | Hitchcock | 335/295 |
| 2,972,485 | 2/1961 | Ferchland | 335/295 |
| 3,452,310 | 6/1969 | Israelson | 335/295 X |
| 3,978,441 | 8/1976 | Sobottka et al. | 335/289 X |
| 4,055,824 | 10/1977 | Baermann | 335/295 X |

*Primary Examiner*—George Harris

*Attorney, Agent, or Firm*—Haseltine and Lake

[57] ABSTRACT

The lifting device consists of an outer magnetic yoke and internal pole pieces forming an anchoring or working surface, with secondary permanent magnetic elements located between the yoke and the aforementioned pole pieces. There is also a reversible permanent magnetic element which may be rotated manually on a parallel axis to the said pole pieces, between an operative position in which its magnetic field is parallel to that of said secondary magnetic elements, and an inoperative position in which the magnetic field is short-circuited.

9 Claims, 4 Drawing Figures

MANUALLY CONTROLLED MAGNETIC LIFTING DEVICE

BACKGROUND OF THE INVENTION

This invention concerns a manually controlled magnetic lifting device, with which it is possible to lift relatively heavy loads with either flat, circular or similar shaped anchoring surfaces.

The magnetic lifting device of this invention differs from the usual magnetic lifting device in virtue of its simple but sturdy structure, as well as its reduced dimensioning, due to the particular configuration of its magnetic circuit; therefore, with the same quantity of magnetic material, the lifting apparatus according to the invention makes it possible to obtain a greater magnetic power and a relatively low weight.

Whereas the presence of an external magnetic yoke prevents any undesirable magnetic interference with nearby material, it also constitutes a protection against bumps and magnetic damage to the lifting device itself.

SUMMARY OF THE INVENTION

On general lines, according to the invention there is provided a manually controlled magnetic lifting device comprising: an external magnetic yoke forming the base and two sidewalls; a first and a second inside pole piece which are, respectively parallel to the sidewalls and fixed to the base of the yoke by means of interposing spacer elements; a reversible permanent magnetic element inserted between the pole pieces, the said reversible mangetic element being rotary supported on a parellel axis to the above-mentioned pole pieces and having a polarization direction at right angles to the axis of rotation itself; and secondary magnetic elements inserted between each pole piece and the magnetic yoke; said secondary magnetic elements, for each pole piece, consisting of a first set of permanent magnets with an axis of magnetization at right angles to the pole piece and, respectively, a second set of permanent magnets housed in the spacer elements with an axis of magnetization parallel to, and in line with the pole piece itself.

The use of a rotary-type reversible magnetic element and a special automatic control lever locking system make it extremely easy to handle and perfectly safe in the case of accidental desactivation of the lifting device.

BRIEF DESCRIPTION OF THE DRAWINGS

These and other features of the magnetic lifting device according to this invention will be illustrated in detail below, referring to the example of the annexed drawings in which.

Figure 1:
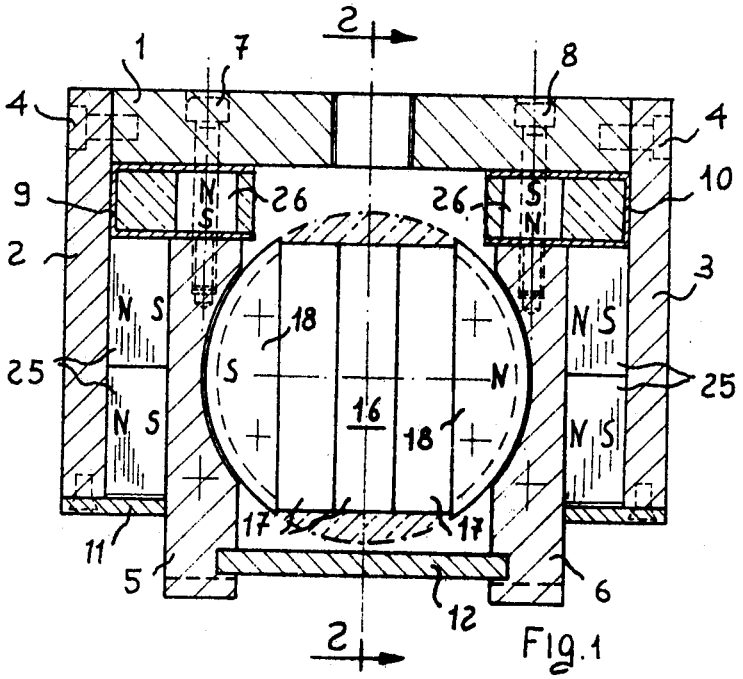
FIG. 1 represents a cross section showing the internal structure of the lifting device.

As shown in the section of FIG. 1, the lifting device consists of an external yoke in ferromagnetic material, made up of a base 1, and two sidewalls 2 and 3 fixed, for example bolted at 4 to the base itself. Inside the magnetic yoke 1, 2, 3 are two pole pieces 5, 6 arranged parallely and spaced from the faces of the sidewalls 2, 3 of the magnetic yoke. The pole pieces 5, 6 protrude downwards with respect to the magnetic yoke as shown, and are fixed, for example bolted at 7 and 8 to the base 1 by means of insertion of spacers of non-ferromagnetic material, for example, in the form of C-shaped elements 9 and 10 in aluminium. Aluminium plates 11 and 12 respectively close from below the magnetic yoke and the pole pieces as shown, whilst aluminium lids 14 and 15 close the two ends of the external magnetic yoke. Inside, between the pole pieces is a permanent magnetic element 16, rotary supported on a horizontal axis and parallel to the planes of the pole pieces 5 and 6; this magnetic element is polarized at a right angle direction to the axis of rotation itself, in this way it is possible to substantially reverse its polarization by means of a rotation equal to or close on 180° .

The reversible magnetic element 6 is a cylindrical structure which partially interpenetrates into semicylindrical slots situated on the inner sides of the two pole pieces 5 and 6; in particular, the magnetic element 16 consists of permanent magnetic cores 17 inserted between two semicylindrical pole pieces 18 and which are all held together by the end flanges 19 and 20 in stainless steel, bolted to the above-mentioned semicylindrical pole pieces 18.

On the outer side the flanges 19 and 20 are provided with a pivot 21 and 22 respectively, which defines the horizontal axis of rotation of the reversible magnetic element 16. The pivots 21 and 22 are mounted on ball bearings 23 situated in housings in the end lids 14 and 15; in detail, the pivot 22 protrudes externally from the lid 15 for securing the control lever 24 (FIG. 3)

The magnetic circuit of the lifting device also comprises the secondary permanent magnets 25 and 26 inserted between each pole piece 5 and 6 and the above-mentioned magnetic yoke, and more precisely, as shown in the cross section of FIG. 1, the secondary magnets 25 are inserted between the pole pieces 5, 6 and the sidewalls 2, 3 of the magnetic yoke, with the polarization shown, that is to say, having a magnetic axis directed at right angles to the surface of the pole pieces themselves. Each magnet 26 on the contrary, is inserted into the channel section 9 and 10 respectively, with its axis of polarization in line with the corresponding pole piece; the secondary magnets are arranged in such a way that the poles of the magnets facing each pole piece are of the same sign, but opposite in sign to that of the poles relative to the secondary magnets of the other pole piece. An internal shoulder 14' and 15' on the two lids 14 and 15 is inserted into the ends of the pole pieces helping to keep the reversible magnetic element 16 centered.

As mentioned previously, in the position shown in FIG. 1 of the reversible magnetic element 16, the latter is situated parallel to the magnets 25, 26 creating a magnetic field which, by means of the pole pieces 5, 6 is closed by the load to be lifted (not shown). By inverting the magnetic element 16, by operating manually upon the control lever 24 until it comes to rest in the dotted position in FIG. 3, against the stop 27, that is to say a rotation equal to or approximately 180° , the reversible magnetic element 16 comes to rest in series with the magnets 25, 26 creating a magnetic field which short circuits through the extenal magnetic yoke which always proves neutral in both cases, that is to say, either with the lifting device activated or desactivated; therefore it does not interfere with any eventual nearby ferrous material and at the same time protects the magnetic circuit of the lifting device.

Figure 3:
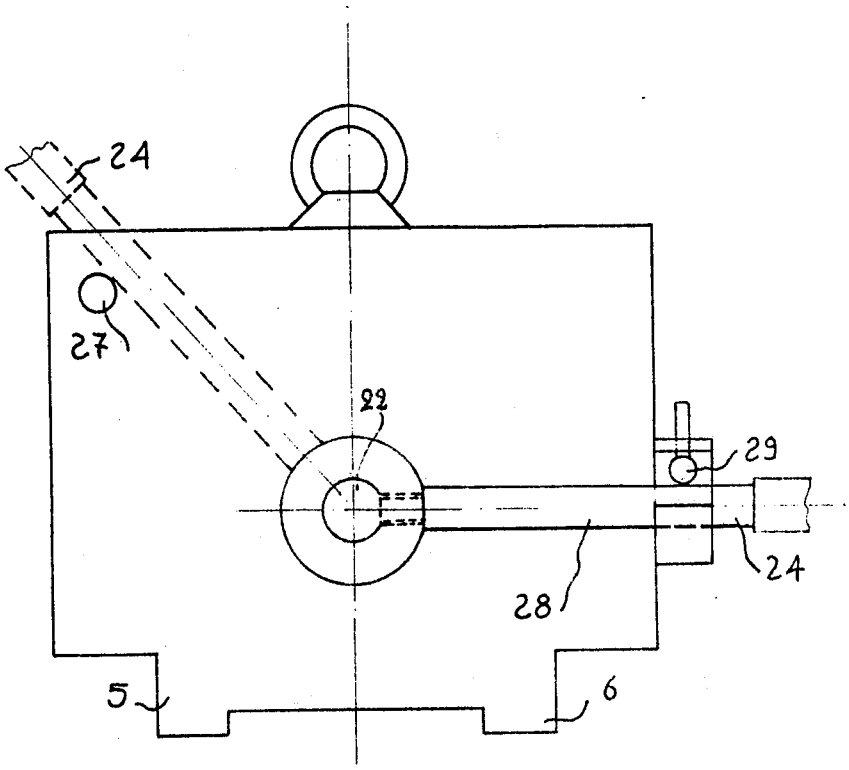
FIG. 3 represents an end view from the control lever side.
Figure 4:
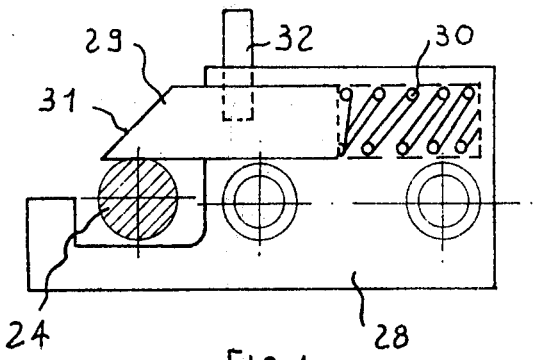
FIG. 4 represents an enlarged detail of the automatic control lever locking device.

Still referring to FIGS. 3 and 4 it can be seen that an automatic device 28 is provided for locking the lever 24 in the activated lifting device position. This locking device 28 consists of a pawl 29 biased from its internal end by a spring 30, and with its external end 31 chamfered to facilitate the sliding of the lever 24 during rotation of the latter. A pin 32 connected to the pawl 29 projects upwards, so that, using the same hand which grips the lever 24, it is possible to act upon the pin 32 in order to press in the pawl and unlock the lever itself; it is understood however, that any other locking device may be used in place of the pawl locking device, as long as it is suitable for the purpose for which it is foreseen.

Figure 2:
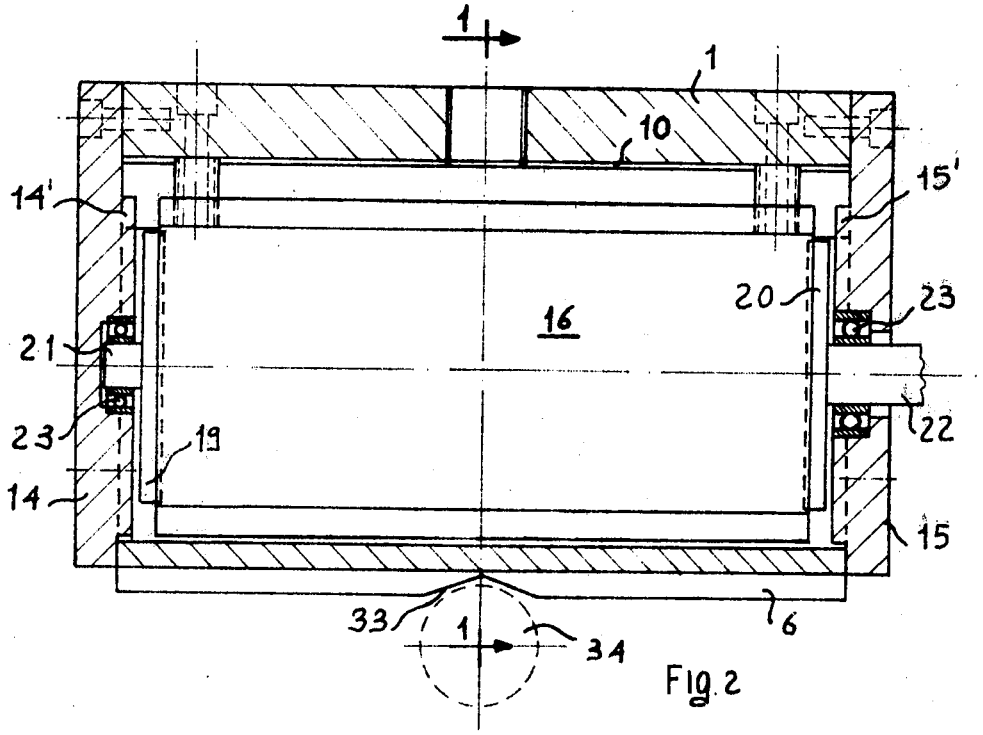
FIG. 2 represents a longitudinal section along the line 2—2 of FIG. 1

We wish to point out, from the FIGS. 1 and 2, that the work surface of the pole pieces 5, 6 is essentially flat over the entire length of the pole pieces themselves, except in an intermediate zone where the pole pieces 5, 6 present a slot 33 or sloping surfaces by which it is possible to lift cylindrical or similar shaped ferromagnetic parts 34.

What is claimed is:

1. Manually controlled magnetic lifting device, comprising an external magnetic yoke forming a base, and two sidewalls; a first and a second pole piece respectively inside and parellel to the sidewalls, secured to the base of the yoke by means of insertion of spacers; a reversible permanent magnetic element inserted between the pole pieces, said reversible magnetic element being rotary supported on a parallel axis to the aformentioned pole pieces and with a polarization direction at right angles to the axis of rotation itself, and secondary magnetic elements inserted between each pole piece and the magnetic yoke, said secondary magnetic elements, for each pole piece, comprising a first set of permanent magnets with axis of magnetization at right angles to the surface of the pole pieces and, respectively, a second set of permanent magnets housed in the spacers, with axis of magnetization parallel and in line with the pole pieces themselves.

2. Lifting device according to claim 1, in which said reversible magnetic element comprises a cylindrical structure consisting of a set of permanent magnets inserted between semicylindrical pole pieces, and the entire unit secured by means of end flanges fixed to the aforesaid pole pieces.

3. Lifting device according to claim 2, in which the said reversible magnetic element of cylindrical shape, partially penetrates into semicylindrical slots on the inner sides of the pole pieces.

4. Lifting device according to claim 2, in which said flanges have rotary pivots supported by means of ball bearings.

5. Lifting device according to claim 4, in which said magnetic yoke is closed at each end by lids and that the ball bearings for the reversible magnetic element are situated in housings formed in said lids.

6. Lifting device according to claim 1, in which the pole pieces are provided with slots at an intermediate position.

7. Lifting device according to claim 1, in which the pole pieces protude downwards with respect to the external magnetic yoke.

8. Lifting device according to claim 1, provided with an automatic lock device for a control lever in the working position of said reversible magnetic element.

9. Lifting device according to claim 8, in which the automatic lock device consists of a pawl biased by a spring and provided with a manual control pin.

* * * * *